US012529266B2

(12) United States Patent
Ignova et al.

(10) Patent No.: US 12,529,266 B2
(45) Date of Patent: Jan. 20, 2026

(54) AUTOMATED CONTROL OF TRAJECTORY OF DOWNHOLE DRILLING

(71) Applicant: Schlumberger Technology Corporation, Sugar Land, TX (US)

(72) Inventors: Maja Ignova, Cheltenham (GB); Katharine Mantle, Cheltenham (GB); Ekaterina Brovko, Cheltenham (GB); Martin Jones, Gloucester (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/644,476

(22) Filed: Apr. 24, 2024

(65) Prior Publication Data

US 2024/0352800 A1 Oct. 24, 2024

Related U.S. Application Data

(60) Provisional application No. 63/497,854, filed on Apr. 24, 2023.

(51) Int. Cl.
*E21B 7/06* (2006.01)
*E21B 44/00* (2006.01)

(52) U.S. Cl.
CPC ..... *E21B 7/06* (2013.01); *E21B 44/005* (2013.01)

(58) Field of Classification Search
CPC ..... E21B 7/04; E21B 7/06; E21B 44/005
See application file for complete search history.

(56) References Cited

U.S. PATENT DOCUMENTS

| | | | | |
|---|---|---|---|---|
| 9,273,547 | B2 | 3/2016 | Brooks et al. | |
| 9,982,525 | B2 | 5/2018 | Brooks et al. | |
| 2014/0196950 | A1 | 7/2014 | Bayliss | |
| 2015/0377004 | A1 | 12/2015 | Hornblower et al. | |
| 2018/0363444 | A1* | 12/2018 | Hornblower | E21B 45/00 |
| 2019/0169977 | A1 | 6/2019 | Maus et al. | |
| 2020/0080380 | A1 | 3/2020 | Gorrara et al. | |
| 2021/0095526 | A1* | 4/2021 | Chanpura | E21B 10/62 |

FOREIGN PATENT DOCUMENTS

WO 2011130159 A2 10/2011

* cited by examiner

*Primary Examiner* — Dany E Akakpo
(74) *Attorney, Agent, or Firm* — Jeffrey D. Frantz

(57) ABSTRACT

Methods and systems are provided for automated closed-loop control of drilling trajectory during directional drilling, which define target inclinations and/or target azimuths for a sequence of automated control loops performed over distances of measured depth during directional drilling, wherein the sequence of automated control loops transition from drilling a curve or bend in a wellbore to drilling a horizontal or lateral section or tangent section of the wellbore. In embodiments, the sequence of automated control loops can be configured to incrementally change dog leg severity of the wellbore in a pre-defined manner with the final dog leg severity being at or near zero.

21 Claims, 7 Drawing Sheets

AUTOMATED CONTROL OF TRAJECTORY OF DOWNHOLE DRILLING

CROSS-REFERENCE TO RELATED APPLICATION(S)

The present disclosure claims priority from U.S. Prov. Appl. No. 63/497,854, filed on 24 Apr. 2023, entitled "AUTOMATED CONTROL OF TRAJECTORY OF DOWNHOLE DRILLING", herein incorporated by reference in its entirety.

FIELD

The disclosed embodiments relate generally to methods for directional control during downhole directional drilling operations.

BACKGROUND

The use of automated drilling methods is becoming increasingly common in drilling subterranean wellbores. Such methods may be employed, for example, to control the direction of drilling based on various downhole feedback measurements, such as inclination and azimuth measurements made while drilling or logging while drilling measurements.

One difficulty with automated drilling methods (and directional drilling methods in general) is that directional drilling tools exhibit tendencies to drill in a direction offset from the set point direction. For example, when set to drill a horizontal well straight ahead, certain drilling tools may tend to drop inclination (turn downward) and/or to turn to the left or right. Exacerbating this difficulty, these tendencies can be influenced by numerous factors and may change unexpectedly during a drilling operation. Factors influencing the directional tendency may include, for example, properties of the subterranean formation, the configuration of the bottom hole assembly (BHA), bit wear, bit/stabilizer walk, an unplanned touch point (e.g., due to compression and buckling of the BHA), stabilizer-formation interaction, the steering mechanism utilized by the steering tool, and various drilling parameters.

In current drilling operations, a drilling operator generally corrects the directional tendencies by evaluating wellbore survey data transmitted to the surface. A surface computation of the gravity toolface of the well is generally performed at 30-to-100-feet intervals (e.g., at the static survey stations). While such techniques are serviceable, there is a need for further improvement, particularly for automatically accommodating (or correcting) such tendencies downhole while drilling.

SUMMARY

Methods and systems are provided for automated closed-loop control of drilling trajectory during directional drilling, which define target inclinations and/or target azimuths for a sequence of automated control loops performed over distances of measured depth during directional drilling. The sequence of automated control loops transition from drilling a curve or bend in a wellbore to drilling a horizontal or lateral section or tangent section of the wellbore.

In embodiments, the sequence of automated control loops can be configured to incrementally change dog leg severity of the wellbore in a pre-defined manner with the final dog leg severity being at or near zero.

In embodiments, the sequence of automated control loops can be activated or initiated by instructions or commands from a drilling operator, or automatically by instructions or commands from a processor or other programmed controller during directional drilling.

In embodiments, the activation or initiation of the sequence of automated control loops can be performed automatically based on at least one parameter that specifies an offset relative to a target landing. For example, the at least one parameter can specify a predefined offset (such as 3 degrees) from a target landing inclination, and the activation or initiation of the sequence of automated control loops can be configured to occur automatically in the event that the inclination of drilling represented by target inclination or measured inclination reaches the predefined offset from the target landing inclination.

In embodiments, the sequence of automated control loops can be terminated by instructions or commands from a drilling operator, or automatically by instructions or commands from a processor or other programmed controller during directional drilling.

In embodiments, the termination of the sequence of automated control loops can be performed automatically based on at least one parameter that specifies an offset relative to a target landing. For example, the at least one parameter can specify a predefined offset of measured depth from the target landing, and the termination of the sequence of automated control loops can occur automatically in the event that an elapsed measured depth of drilling during the sequence of automated control loops matches or corresponds to the predefined offset of measured depth from the target landing.

In embodiments, a rate of penetration of drilling during the sequence of automated control loops can be kept constant or estimated downhole and used as input to a processor or other programmed controller.

In embodiments, the sequence of automated control loops can be configured by a pre-determined setting that is set before drilling the wellbore.

In embodiments, the sequence of automated control loops can employ a plurality of nudge operations that define target inclinations and/or target azimuths for the sequence of automated control loops.

In embodiments, the plurality of nudge operations can use rate of penetration (ROP) of the directional drilling as an input. The rate of penetration (ROP) of the directional drilling can be controlled via the surface or estimated downhole by a processor or other programmed controller.

In embodiments, the plurality of nudge operations can calculate the target inclinations and/or target azimuths for the sequence of automatic control loops by changing the dog leg severity of the directional drilling over a specified measured depth or distance.

In embodiments, the plurality of nudge operations can calculate the target inclinations and/or target azimuths for the sequence of control loops based on variable dog leg severity demand.

In embodiments, the variable dog leg severity demand can be represented by variable percentage values of the dog leg severity of the curve of the wellbore at the start of the method.

In embodiments, the plurality of nudge operations can calculate the target inclinations and/or target azimuths for the sequence of automated control loops based on variable toolface demand.

In embodiments, the variable toolface demand can be configured to automatically change target inclination and/or target azimuth over distances of measured depth during directional drilling for a predefined total change in inclination over measured depth of drilling.

In embodiments, the variable toolface demand can be based on at least one predefined function or computational model of landing having elapsed measure depth as an independent variable.

In embodiments, the variable toolface demand can be based on a plurality of different computational models of landing that are automatically selected by evaluating elapsed measured depth of drilling.

In embodiments, the sequence of automated control loops can be HIA control loops that continuously monitor and control a drilling toolface to drill in a direction corresponding to the target inclination and/or target azimuth.

In embodiments, the target azimuth can be kept constant over the sequence of automated control loops for two-dimensional directional drilling. In other embodiments, the target azimuth can be varied over the sequence of automated control loops for three-dimensional directional drilling.

The disclosed embodiments may provide various technical advantages. For example, the disclosed embodiments provide for real-time closed loop control of the drilling direction. As such, the disclosed methods may provide for improved well placement and reduced wellbore tortuosity. Moreover, by providing for closed loop control, the disclosed methods tend to improve drilling efficiency and consistency.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

Figure 1:
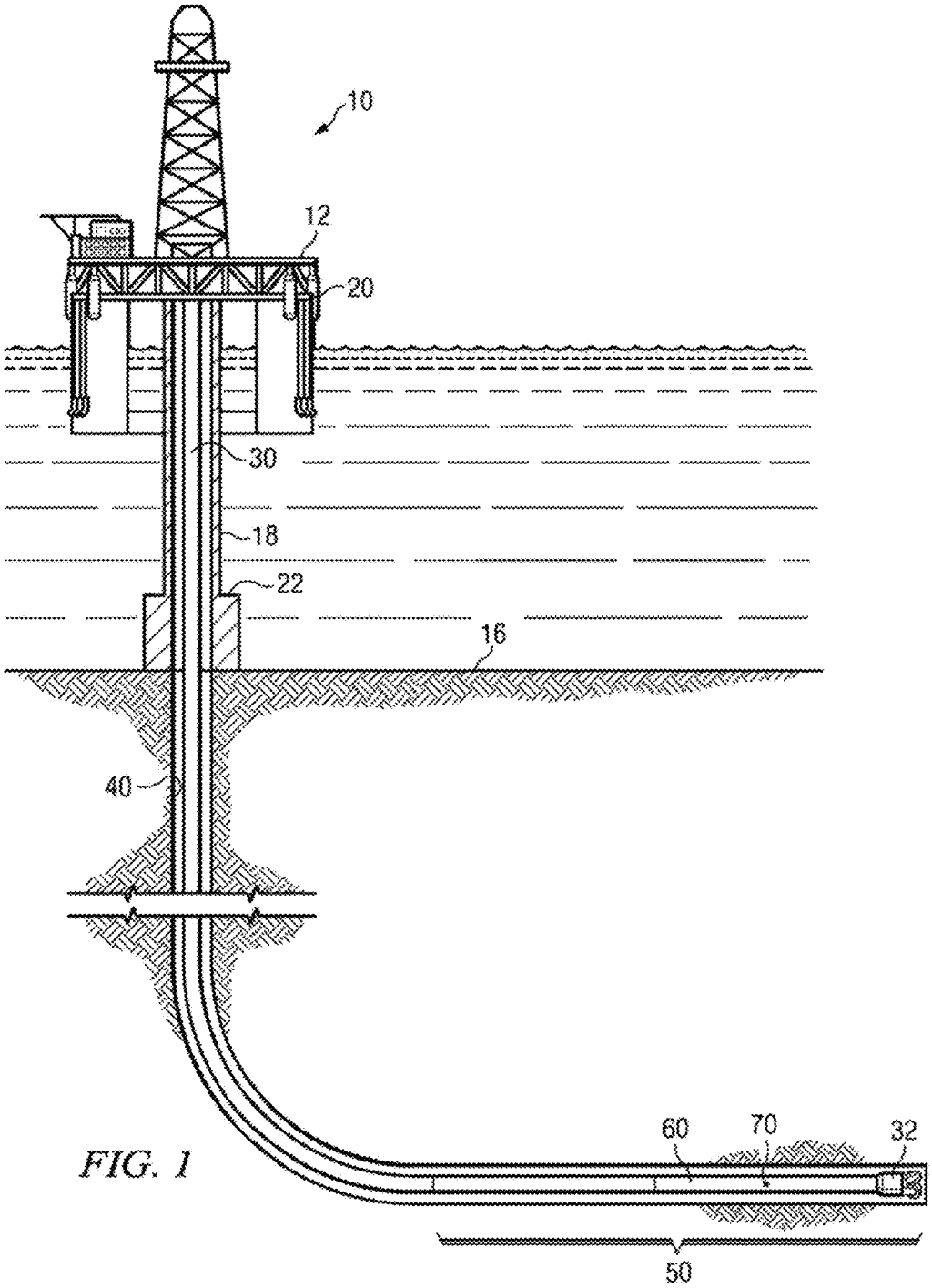
FIG. 1 depicts an example drilling rig on which disclosed embodiments may be utilized.

FIG. 1 depicts a drilling rig 10 suitable for using various method and system embodiments disclosed herein. A semi-submersible drilling platform 12 is positioned over an oil or gas formation (not shown) disposed below the sea floor 16. A subsea conduit 18 extends from deck 20 of the semisubmersible drilling platform 12 to a wellhead installation 22. The semisubmersible drilling platform 12 may include a derrick and a hoisting apparatus for raising and lowering a drill string 30, which, as shown, extends into borehole 40 and includes a bottom hole assembly (BHA) 50. The BHA 50 includes a drill bit 32, a steering tool 60 (also referred to as a directional drilling tool), and one or more downhole navigation sensors 70 such as measurement while drilling sensors including three axis accelerometers and/or three axis magnetometers. The BHA 50 may further include substantially any other suitable downhole tools such as a downhole drilling motor, a downhole telemetry system, a reaming tool, and the like. The disclosed embodiments are not limited with regard to such other tools.

It will be understood that the BHA may include substantially any suitable steering tool 60, for example, including a rotary steerable tool. Various rotary steerable tool configurations are known in the art including various steering mechanisms for controlling the direction of drilling. For example, many existing rotary steerable tools include a substantially non-rotating outer housing employing blades that engage the borehole wall. Engagement of the blades with the borehole wall can be controlled to vary the attitude of the drill bit during drilling, thereby pointing or pushing the drill bit in a desired direction while drilling. A rotating shaft deployed in the outer housing transfers rotary power and axial weight-on-bit to the drill bit during drilling. Accelerometer and magnetometer sets may be deployed in the outer housing and therefore are non-rotating or rotate slowly with respect to the borehole wall.

In one embodiment, the BHA 50 can employ a rotary steerable system, such as the PowerDrive rotary steerable system available from SLB which fully rotates with the drill string (i.e., the outer housing rotates with the drill string). The PowerDrive Xceed makes use of an internal steering mechanism that is not requiring contact with the borehole wall and enables the tool body to fully rotate with the drill string. The PowerDrive X5, X6, and POWERDRIVE ORBIT™ rotary steerable systems make use of mud actuated blades (or pads) that contact the borehole wall. The extension of the blades (or pads) is rapidly and continually adjusted as the system rotates in the borehole. The POWERDRIVE ARCHER™ makes use of a lower steering section joined at an articulated swivel with an upper section. The swivel is actively tilted via pistons so as to change the angle of the lower section with respect to the upper section and maintain a desired drilling direction as the bottom hole assembly rotates in the borehole. Accelerometer and magnetometer sets may rotate with the drill string or may alternatively be deployed in an internal roll-stabilized housing such that they remain substantially stationary (in a bias phase) or rotate slowly with respect to the borehole (in a neutral phase). To drill a desired curvature, the bias phase and neutral phase are alternated during drilling at a predetermined ratio (referred to as the steering ratio). Again, the disclosed embodiments are not limited to use with any particular steering tool configuration.

The downhole sensors 70 may include substantially any suitable sensor arrangement used for making downhole navigation measurements (borehole inclination, borehole azimuth, and/or tool face measurements). Such sensors may include, for example, accelerometers, magnetometers, gyroscopes, and the like. Such sensor arrangements are well known in the art and are therefore not described in further detail. The disclosed embodiments are not limited to the use of any particular sensor embodiments or configurations. Methods for making real-time while drilling measurements of the borehole inclination and borehole azimuth are disclosed, for example, in commonly assigned U.S. Pat. Nos. 9,273,547B2 and 9,982,525B2. In the depicted embodiment, the sensors 70 are shown to be deployed in the steering tool 60. Such a depiction is merely for convenience as the sensors 70 may be deployed elsewhere in the BHA.

It will be understood by those of ordinary skill in the art that the deployment illustrated on FIG. 1 is merely an example. It will be further understood that disclosed embodiments are not limited to use with a semisubmersible drilling platform 12 as illustrated on FIG. 1. The disclosed embodiments are equally well suited for use with any kind of subterranean drilling operation, either offshore or onshore.

Figure 2:
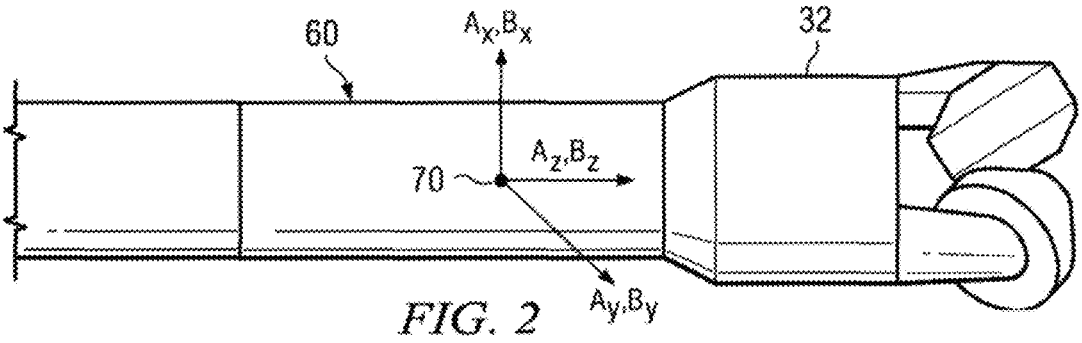
FIG. 2 depicts a lower BHA portion of the drill string shown on FIG. 1.

FIG. 2 depicts the lower BHA portion of drill string 30 including drill bit 32 and steering tool 60. As described above with respect to FIG. 1, the steering tool may include navigation sensors 70 including tri-axial (three axis) accelerometer and magnetometer navigation sensors. Suitable accelerometers and magnetometers may be chosen from among substantially any suitable commercially available devices known in the art. FIG. 2 further includes a diagrammatic representation of the tri-axial accelerometer and magnetometer sensor sets. By tri-axial it is meant that each sensor set includes three mutually perpendicular sensors, the accelerometers being designated as $A_x$, $A_y$, and $A_z$ and the magnetometers being designated as $B_x$, $B_y$, and $B_z$. $B_y$ convention, a right-handed system is designated in which the z-axis accelerometer and magnetometer ($A_z$ and $B_z$) are oriented substantially parallel with the borehole as indicated (although disclosed embodiments are not limited by such conventions). Each of the accelerometer and magnetometer sets may therefore be considered as determining a plane (the x and y-axes) and a pole (the z-axis along the axis of the BHA).

Figure 3:
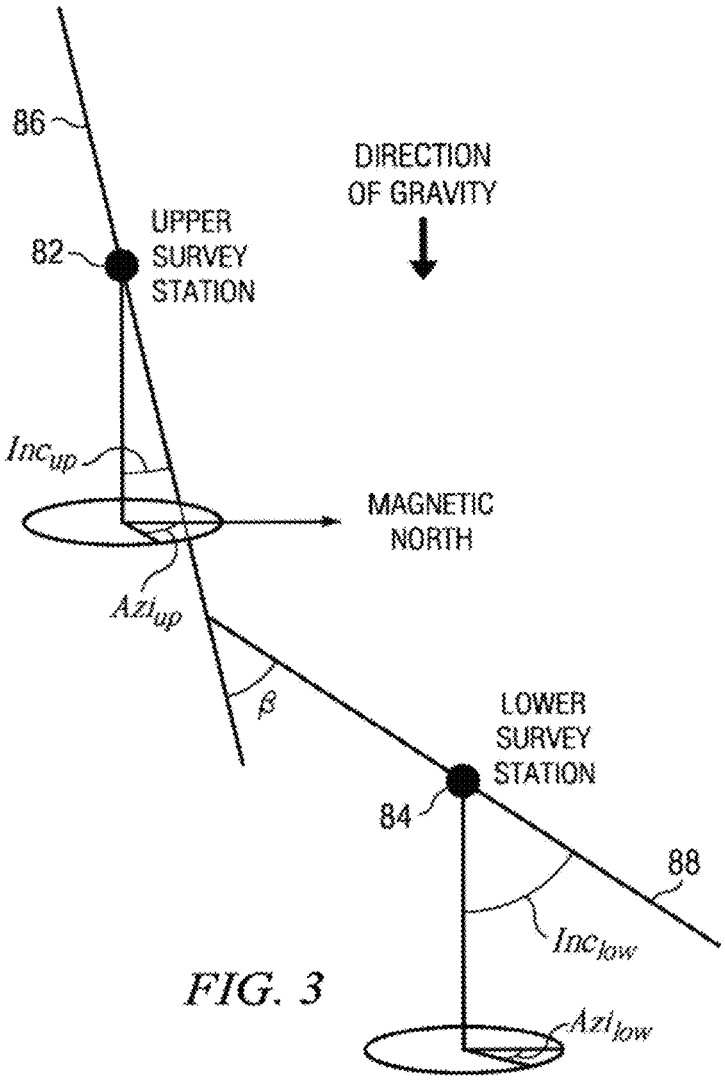
FIG. 3 depicts a diagram of attitude and steering parameters in a global coordinate reference frame.

FIG. 3 depicts a diagram of attitude in a global coordinate reference frame at upper and lower survey stations 82 and 84. The attitude of a BHA defines the orientation of the BHA axis (axis 86 at the upper survey station 82 and axis 88 at the lower survey station 84) in three-dimensional space. In wellbore surveying applications, the wellbore attitude represents the direction of the BHA axis in the global coordinate reference frame (and is commonly understood to be approximately equal to the direction of propagation of the drill bit). Attitude may be represented by a unit vector the direction of which is often defined by the borehole inclination and the borehole azimuth. In FIG. 2 the borehole inclination at the upper and lower survey stations 82 and 84 is represented by $Inc_{up}$ and $Inc_{low}$ while the borehole azimuth is represented by $Azi_{up}$ and $Azi_{low}$. The angle R represents the overall angle change of the borehole between the first and second survey stations 82 and 84.

Figure 4:
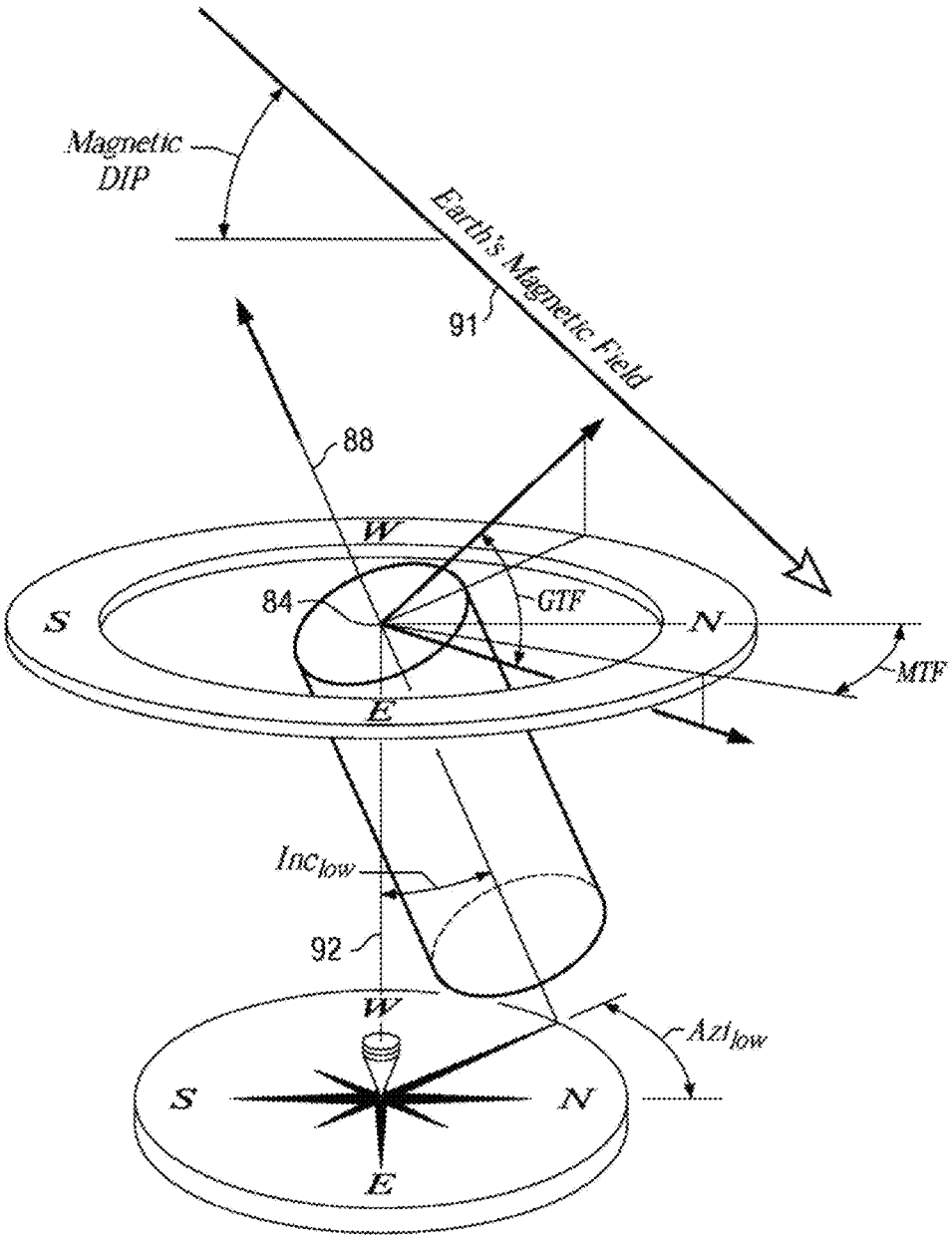
FIG. 4 depicts a diagram of gravity toolface and magnetic toolface in a global reference frame.

FIG. 4 depicts a further diagram of attitude and toolface in a global coordinate reference frame at the second lower survey station 84. The Earth's magnetic field and gravitational field are depicted at 91 and 92. The borehole inclination $Inc_{low}$ represents the deviation of axis 88 from vertical while the borehole azimuth $Azi_{low}$ represents the deviation of a projection of the axis 88 on the horizontal plane from magnetic north. Gravity toolface (GTF) is the angular deviation about the circumference of some component of the downhole tool with respect to the highside (HS) of the tool collar (or borehole). In this disclosure, gravity tool face (GTF) represents the angular deviation between the direction towards which the drill bit is being turned and the highside direction (e.g., in a slide drilling operation, the gravity tool face represents the angular deviation between a bent sub scribe line and the highside direction). Magnetic toolface (MTF) is similar to GTF but uses magnetic north as a reference direction. In particular, MTF is the angular deviation in the horizontal plane between the direction towards which the drill bit is being turned and magnetic north.

It will be understood that the disclosed embodiments are not limited to the above-described conventions for defining borehole coordinates depicted in FIGS. 2, 3, and 4. It will be further understood that these conventions can affect the form of certain of the mathematical equations that follow in this disclosure. Those of ordinary skill in the art will be readily able to utilize other conventions and derive equivalent mathematical equations.

In current practices, directional drilling operations have used manual steering to land the well by adjusting the steering ratio and toolface and then activating a control loop that continuously and automatically holds the inclination angle and azimuth angle of the drilling tool (i.e., RSS system) when the bit is projected to be at landing point. This control loop is referred to as an HIA control loop herein. Sometimes, these drilling operations overshoot the desired landing inclination and the drilling tool steers 100% low side in the HIA control loop to try to get to the target inclination, which results in an undesired trajectory.

Alternatively, directional drilling operations have activated the HIA control loop at around three (3) degrees short of the intended landing attitude (e.g. at 87 degrees of the inclination if the desired landing inclination is 90 degrees) and then additional nudge commands are used to increment up to the desired landing attitude. These nudges are dependent on the surface ROP and if landing is needed at specific elapsed measured depth, the ROP may need to be sacrificed. The ROP is usually controlled at the surface during this time. This can result in excessive downlinking.

The present disclosure describes a control mode or process for automated closed-loop control of drilling trajectory during directional drilling. This control mode is referred to as "AutoLand" herein. In embodiments, the AutoLand control mode can be activated (manually by instructions or commands from a drilling operator, or automatically by instructions or commands from a processor or other programmed controller) when the directional drilling is to transition from drilling a curve or bend in the wellbore to drilling a horizontal or lateral section of the wellbore or possibly a tangent section of the wellbore. In the tangent section, the attitude of the wellbore is held constant for a certain distance. In embodiments, the AutoLand control mode can be configured to ensure a smooth 'landing' or transition (meaning no sudden changes in dog leg severity) from the dog leg severity of the curve or bend in the wellbore curve to target dog leg severity (e.g., at or near zero) of the horizontal or lateral section or tangent section of the wellbore. This can improve performance of the directional drilling using closed loop automated drilling.

The Auto-Land control mode can be activated (manually by instructions or commands from a drilling operator, or automatically by instructions or commands from a processor or other programmed controller) during directional drilling in the event that the inclination of the drilling tool (e.g., RSS system) reaches a predefined offset (such as 3 degrees) from the desired landing inclination (e.g., where the inclination is 87 degrees for a desired landing inclination of 90 degrees inclination). The rate of penetration (ROP) of the directional drilling during the Auto-Landing control mode can be kept constant at the surface or estimated downhole and used as input to a processor or other programmed controller. It is envisaged that, after the directional drilling operations reach the predefined landing inclination, the Auto-Landing control mode can be terminated and the control switched to the HIA control loop after a default distance (e.g., 100 feet) has been drilled and certain statistical criteria are met.

In embodiments, one downlink can be used to activate the AutoLand control mode.

In other embodiments, no downlink can be required to activate the AutoLand control mode. In this embodiment, the AutoLand control mode can be triggered by a pre-determined setting such as inclination of the drilling tool (e.g., RSS system). For example, the AutoLand control mode could possibly be set before drilling a particular wellbore by adding 'engage AutoLand at xxdeg inclination' to pre-job settings. The user could enter a value for the inclination angle (or offset from the desired landing inclination angle) that will trigger the AutoLand control mode as part of the pre-job settings for directional drilling of the particular wellbore.

In embodiments, during the AutoLand control mode, a number of nudge operations are used to define target inclinations and/or target azimuths for a sequence of HIA control loops performed over relatively small distances (i.e., less than 100 feet) of measured depth during directional drilling. Each HIA control loop continuously monitors and controls the toolface to drill in a direction corresponding to the target inclination and/or target azimuth for a relatively small distance of measured depth as configured by the associated nudge operation. In this manner, each HIA control loop as configured by the nudge operation continuously and automatically holds the inclination angle and azimuth angle of the drilling tool (e.g., RSS system) over a relatively small distance of measured depth during directional drilling. The nudge operations can be configured to incrementally adjust the target inclinations and/or target azimuths of the sequence of HIA control loops to automatically transition the drilling tool (e.g., RSS system) from drilling the curve or bend in the wellbore to drilling a horizontal or lateral section of the wellbore or possibly a tangent section of the wellbore without user input.

In embodiments, the nudge operations can calculate the target inclinations and/or target azimuths for the sequence of HIA control loops using the rate of penetration (ROP) of the directional drilling as an input. In embodiments, during the AutoLand control mode, the rate of penetration (ROP) of the directional drilling can be controlled via the surface or estimated downhole by a processor or other programmed controller. In the event that a different rate of penetration (ROP) is selected at the surface during the AutoLand control mode, then the selected rate of penetration (ROP) can be downlinked to the tool as required.

In embodiments, during the AutoLand control mode, the target azimuth can be kept constant for two-dimensional directional drilling.

In other embodiments, during the AutoLand control mode, the target azimuth can be varied for three-dimensional directional drilling.

In embodiments, the nudge operations can calculate the target inclinations and/or target azimuths for the sequence of HIA control loops by changing the dog leg severity of the directional drilling to zero over a specified measured depth or distance. In embodiments, the specified measured depth or distance can be set at 100 feet by default. Alternatively or additionally, the specified measured depth or distance can be set by user input, such as a pre-defined value when the tool is initialized prior to the directional drilling operations or downlinked to the drilling tool during the directional drilling operations.

In embodiments, the nudge operations can calculate the target inclinations and/or target azimuths for the sequence of HIA control loops based on variable dog leg severity demand, which is referred to herein as Proposal 1. In embodiments, the variable dog leg severity demand can be represented by variable percentage values (e.g., 80%, 60%, 40%, 20%, 0%) of the dog leg severity of the curve of the wellbore at the start of the Autoland Control Mode.

Ideally, the dog leg severity of the wellbore should be high initially (close to the curve DLS) and zero (or close-to zero) at the end of AutoLand control mode. To satisfy these constraints, the changes in the dog leg severity over drilling distance during the AutoLand control mode can be controlled such that at the start of the AutoLand control mode, the dog leg severity is maintained at 80% of the dog leg severity of the curve of the wellbore for some distance drilled and then gradually the dog leg severity is changed to 60%, 40%, 20% and 0% of the dog leg severity of the curve of the wellbore over certain distances drilled over a total distance drilled for the AutoLand control mode (e.g., 100 feet distance). The individual distances drilled for the dog leg severity demands (80%, 60%, 40%, 20% and 0% of the dog leg severity of the curve of the wellbore) need not be unique values and can be dependent on the dog leg severity of the curve of the wellbore and the overall change in inclination required.

For example, TABLE 1 below shows changes in dog leg severity (DLS) demand over distances drilled in the AutoLand control mode for the case where the dog leg severity of the curve of the wellbore is 8 degrees/100 feet.

TABLE 1

| MD (ft) - distance drilled in the AutoLand control mode | DLS demand (% of the DLS for the curve at the start of the Autoland Control Mode) | DLS demand (deg/100 ft) for DLS initial = 8 deg/100 ft |
|---|---|---|
| 15 | 80% | 6.4 |
| 20 | 60% | 4.8 |
| 20 | 40% | 3.2 |
| 30 | 20% | 1.6 |
| 15 | 0 | 0 |

After 100 ft is drilled in the AutoLand control mode and certain criteria are met (e.g., the resultant DLS is close to 0 deg/100 ft and/or the inclination response is close to the target inclination over a certain time/depth interval), the tool can be controlled to automatically drill in an HIA control loop or possibly activate another mode (e.g., manual control of directional drilling).

Figure 5:
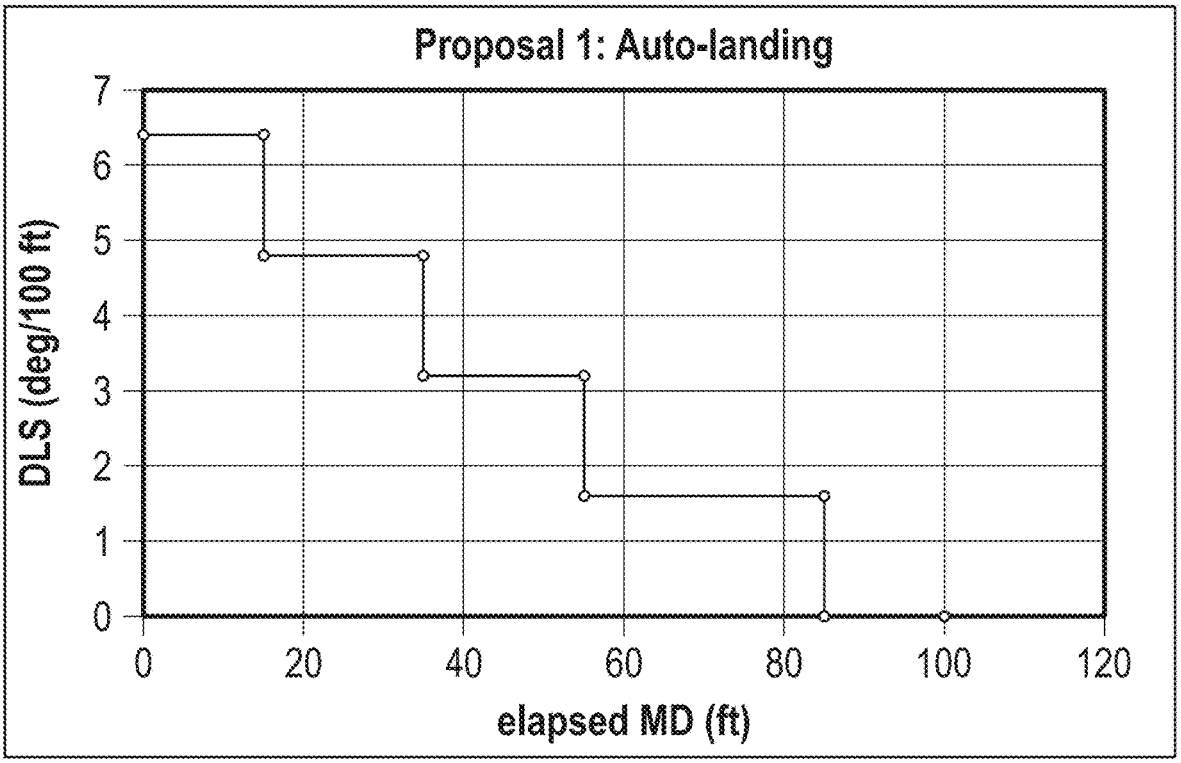
FIG. 5 is a plot of incremental adjustments to dog leg severity of a wellbore over elapsed measured depth while drilling the wellbore where the trajectory of the drilling is controlled by an automated control method of the present disclosure.
Figure 6:
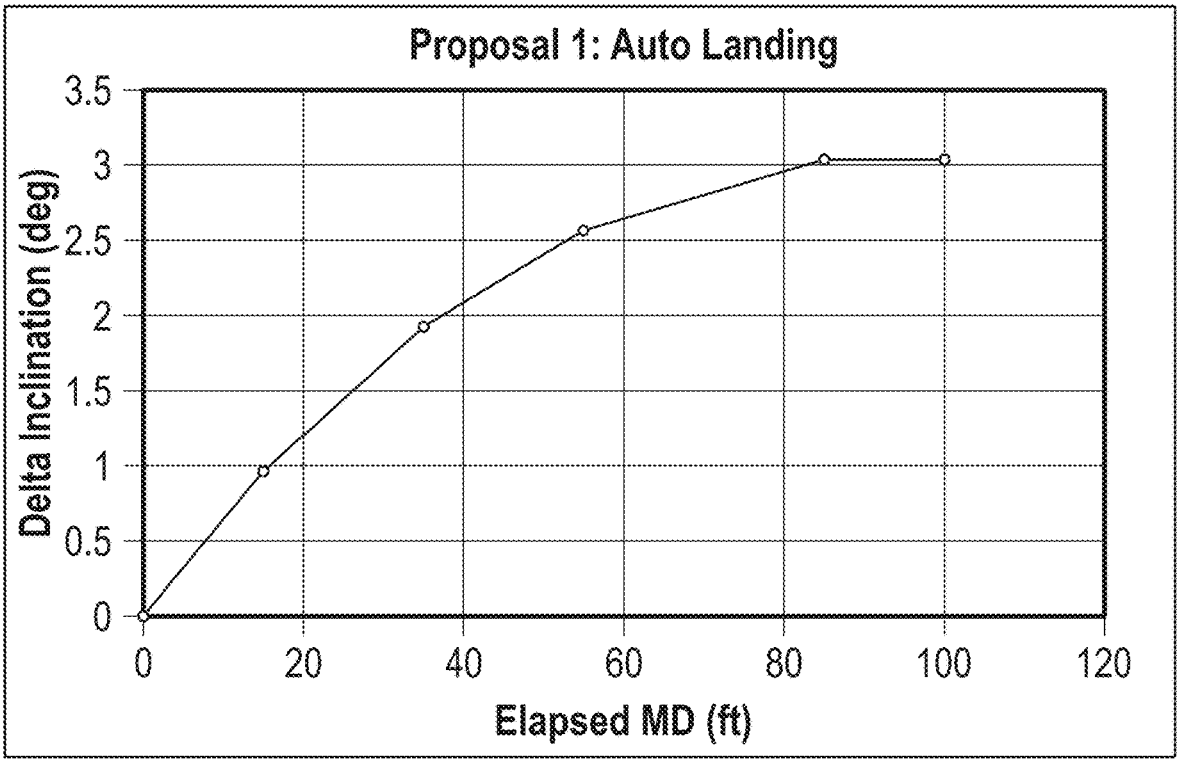
FIG. 6 is a plot of incremental adjustments to target inclination over elapsed measured depth while drilling a wellbore with the trajectory of the drilling controlled by the same automated control method used in FIG. 5.

The dog leg severity (DLS) demand versus elapsed measured depth (MD) for the example of Table 1 is shown in FIG. 5, while inclination changes for those intervals during the AutoLand control mode is shown in FIG. 6. In this case, the target inclination calculated by the nudge operation for each particular interval drilled during the AutoLand control mode can be determined by adding the inclination change(s) for the one or more intervals up to and including the particular interval to the initial inclination at the start of the Autoland control mode.

In other embodiments, the nudge operations can calculate the target inclinations and/or target azimuths for the sequence of HIA control loops based on variable toolface demand, which is referred to herein as Proposal 2. The variable toolface demand can be configured to automatically change the target inclination over relatively small distances of measured depth during directional drilling for a pre-defined total change in inclination (e.g., 3 degrees in total) over estimated measured depth of drilling while keeping azimuth constant. Azimuth nudges can be included in other embodiments. In this manner, the AutoLand control mode can be configured to automatically control the changes in target inclination and possibly target azimuth to a final inclination and final azimuth over a defined distance (elapsed measured depth) using final target inclination and final target azimuth as well as the distance over which the drilling tool (e.g., RSS system) should reach these targets. Any pre-defined function(s) can be used that have an estimated measure depth as an 'independent variable'.

An example first order lag equation to calculate the nudges of inclination in accordance with Proposal 2 for two-dimensional steering for the landing is shown below:

$$IncTarget\,(eMD) = IncInit + IncSP \cdot \left(1 - \exp\left(\frac{-eMD}{MD\ based\ constant}\right)\right) \quad \text{EQN. (1)}$$

where:

- eMD is the elapsed measured depth during the AutoLand control mode (ft) with 0 when the downlink is received and drilling starts; eMD=ROP·eTime;
- ROP is the rate of penetration (ft/h) during AutoLand Control Mode;
- eTime is the elapsed time (h) of the AutoLand Control Mode;
- Inclnit is the initial inclination (deg) at the start of the AutoLand control mode;
- IncTarget is the target inclination (deg) during the AutoLand control mode;
- IncSP is the Inclination Change (deg);
- MD-based constant is a constant (ft) based on measured depth that determines the rate of change of inclination during the AutoLand control mode).

Another example first order lag equation to generate the nudges of azimuth in accordance with Proposal 2 for three-dimensional steering for the landing is shown below:

$$AziTarget\,(eMD) = Azilnit + \frac{AziSPnudge \cdot \left(1 - \exp\left(\frac{-eMD}{MD\ based\ constant}\right)\right)}{\sin(IncTarget(eMD))} \quad \text{EQN. (2)}$$

Where:

- eMD is the elapsed measured depth during AutoLand Control Mode (ft) with 0 when the downlink is received and drilling starts; eMD=ROP·eTime;
- ROP is the rate of penetration (ft/h) during AutoLand Control Mode;
- eTime is the elapsed time (h) of the AutoLand Control Mode;
- Azinit is the initial azimuth (deg) at the start of the AutoLand control mode; a single continuous value is used;
- AziTarget is the target azimuth (deg) during the AutoLand control mode;
- AziSPnudge is the azimuth final angle (deg) requested either being pre-specified or downlinked;
- MD based constant is a constant (ft) based on measured depth that determines the rate of change of azimuth during the AutoLand control mode.

Figure 7:
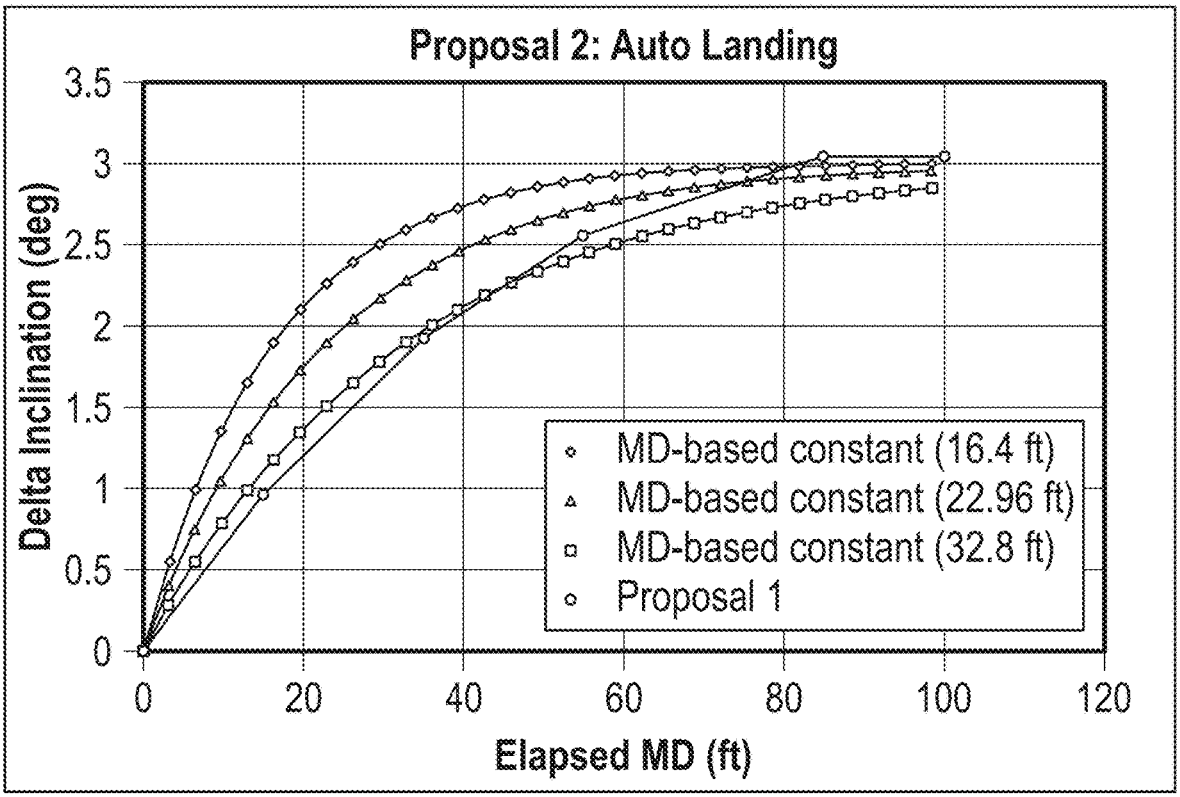
FIG. 7 includes plots of incremental adjustments to target inclination over elapsed measured depth while drilling a wellbore where the trajectory of the drilling is controlled by another automated control method of the present disclosure; the plots are based on different MD-based constants that effect the rate of change of target inclination over the incremental adjustments to target inclination.

FIG. 7 shows the calculation of inclination nudges for Proposal 2 based on Eqn. (1) and three different MD-based constants (MD-based constant=16.4 feet (5 meters), MD-based constant=22.96 feet (7 meters) and MD-based constant=32.8 feet (10 meters)). The MD-based constant can control the desired path. The inclination change IncSP is 3 degrees. The graph only shows the change in the inclination during the AutoLand control mode. The initial inclination is not added (e.g. IncInit=87 degrees). The target inclinations are determined at regularly-spaced points of elapsed time (or elapsed time intervals) during the AutoLand control mode. Similar calculations can be performed for calculation of azimuth nudges for Proposal 2 based on Eqn. (2). In this case, the target azimuths can be determined at regularly-spaced points of elapsed time (or elapsed time intervals) during the AutoLand control mode.

After the target measured depth (e.g., 100 feet) is drilled in the AutoLand control mode and certain criteria are met (e.g., the resultant DLS is close to 0 degrees/100 feet and/or inclination response is close to the target inclination over certain time/depth interval), the tool (e.g., RSS system) can be controlled to automatically drill in an HIA control loop or possibly activate another mode (e.g., manual control of directional drilling).

Figure 8:
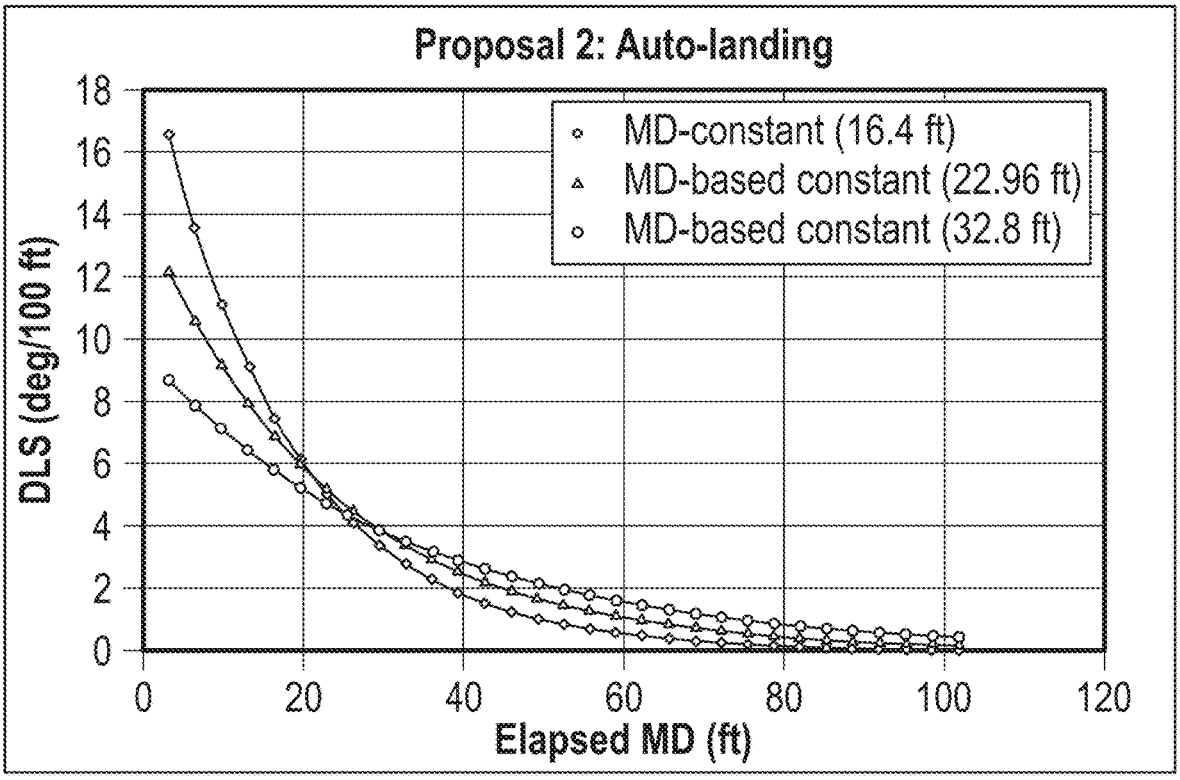
FIG. 8 includes plots of dog leg severity of a wellbore over elapsed measured depth while drilling the wellbore with the trajectory of the drilling controlled by the same automated control method used in FIG. 7; the plots are based on different MD-based constants that effect the rate of change of target inclination over the incremental adjustments to target inclination.

Note that other transfer functions (e.g. second order transfer function) can be used in the AutoLand control mode if needed. The changes in dog leg severity (DLS) during AutoLand control mode over 100 feet of measured depth, according to Eqn. (1), is shown in FIG. 8 for the 3 different MD-constants, going from high demand in the dog leg severity to 0 in the dog leg severity.

In embodiments, true vertical depth (TVD), north-south (NS) and east-west (EW) targets can be calculated from elapsed measured depth, inclination and azimuth values starting with relative values (0,0,0) or any tie-in point. If the drilling tool (e.g., RSS system) knows the target TVD, NS and EW, along with the target inclination and target azimuth, then the Autoland control mode can be configured to modify the target path downhole (self-correction) to achieve as an addition to the target inclination and target azimuth, the target TVD, NS and EW position at landing.

Advantageously, with the AutoLand control mode, the elapsed measured depth of drilling can be controlled downhole more precisely and can work for any required ROP values.

Figure 9:
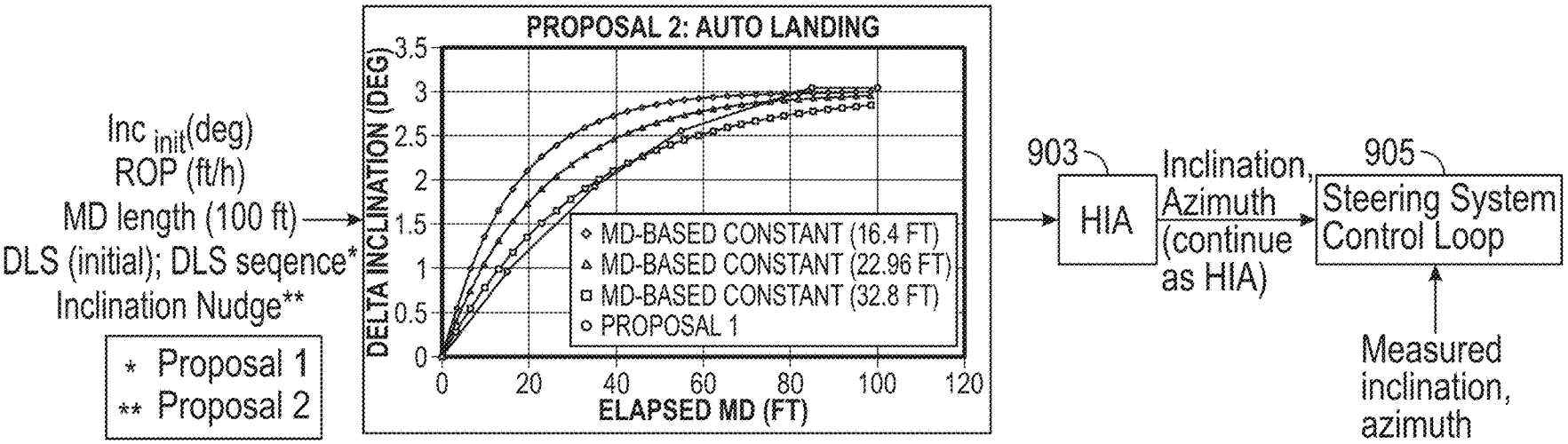
FIG. 9 is a control block diagram that implements the automated control methods of the present disclosure.

FIG. 9 illustrates a control block diagram of the AutoLand control mode for both Proposal 1 and Proposal 2. The inputs to the first block 901 are initial inclination (deg), ROP (ft/h), MD length (length=100 ft), initial DLS and DLS sequence for proposal 1 and inclination and/or azimuthal nudge parameters for proposal 2. The output of block 901 is the demanded target inclination and target azimuth that are passed to the HIA control loop (block 903). The output of the HIA control loop includes the target inclination and azimuth, which is supplied to the steering system control loop (block 905). The steering system control loop (block 905) uses the target inclination and target azimuth and the measured inclination and azimuth of the toolface during drilling, received from sensors to control the direction of drilling such that the measured inclination and azimuth of the toolface tracks the target inclination and azimuth. Blocks 901 and 903 can be configured to perform a sequence of HIA control loops performed over relatively small distances (i.e., less than 100 feet) of measured depth during the directional drilling. The sequence of HIA control loops can incrementally change the dog leg severity of the wellbore in a pre-defined manner with the final dog leg severity being at or near zero.

In embodiments, the AutoLand control mode can also be configured to account for different parameters in calculating the nudges of inclination and/or azimuth. For example, the parameters can include rate of penetration or drill cycle.

In embodiments, the AutoLand control mode can be used to automatically adjust targets for inclination and azimuth. These targets are set-points used as part of a cascade closed-loop system that incrementally change the dog leg severity of the wellbore in a pre-defined manner with the final dog leg severity being at or near zero. This allows the drilling tool (e.g., RSS system) to follow a defined trajectory in a closed-loop manner downhole. The AutoLand control mode can be implemented as a supplementary mode to an auto-curve mode which works with controlled changes in the dog leg severity (DLS) target.

In embodiments, the AutoLand control mode can employ parameters that specify an offset from the target landing, such as a value of offset in measured depth relative to the target landing (which, for example, can be selected from values of 100, 200, 300, and 400 feet) and a value of offset in the inclination relative to the target landing (which, for example, can be selected from values of 3, 6, 9, and 12 degrees). Additionally, the offset from the target landing can include an offset in the azimuth relative to the target landing. These values can be downlinked. Alternatively, the values could be set before drilling a particular wellbore as part of pre-job settings programmed into the drilling tool.

In embodiments, the AutoLand control mode can employ one or more of the parameters that specify the offset from the target landing to automatically activate or initiate the AutoLand control mode. For example, the AutoLand control mode can be automatically activated or initiated when the measured attitude of the drilling tool matches or corresponds to the parameter(s) that specify the offset from the target landing, e.g., when the measured attitude is 87 degrees if the landing inclination is 90 degrees and the offset parameter specifies a 3 degree inclination offset.

In embodiments, the AutoLand control mode can employ the parameter(s) that specify an offset in measured depth relative to the target landing to automatically terminate the AutoLand control mode. For example, the AutoLand control mode can be automatically terminated when an elapsed measured depth matches or corresponds to the parameter(s) that specify the offset in measured depth from the target landing, e.g., when the elapsed measured depth is 200 feet and the offset parameter specifies 200 feet offset in measured depth. The elapsed measured depth can be calculated downhole using the downhole ROP and possibly other parameters. The elapsed measured depth can also be uplinked to the surface, if necessary. The elapsed measured depth can be reset when activating or initiating the AutoLand control mode.

In embodiments, the AutoLand control mode can employ closed-loop control of attitude of the drilling tool in cascade with another controller.

In embodiments, the AutoLand control mode can employ rate of penetration (ROP) in configuring the control, which can be programmed from the surface or estimated or measured downhole. If the ROP is programmed from the surface, then any ROP can be used, and this ROP can be downlinked. An initial ROP can also be programmed in the tool.

In embodiments, the AutoLand control mode can employ downhole drill state in configuring the control.

In embodiments, the AutoLand control mode can employ a parameter specifying maximum DLS of the drilling tool. The parameter specifying maximum DLS can be theoretical, obtained from offset data or estimated during the recent past trajectory (adaptively). In embodiments, the parameter specifying maximum DLS can be used to set the initial build rate (in deg./100 ft) for the AutoLand control mode. In other embodiments, the initial build rate (in deg./100 ft) for the AutoLand control mode can be set to a predefined value, for example in the range of 2 to 5 degrees/100 ft. This predefined value for the initial build rate can be downlinked or programmed into the drilling tool.

In embodiments, the AutoLand control mode can be programmed to perform a particular computational model of landing during the AutoLand control mode, or automatically switch between different computational models of landing during the AutoLand control mode. Each computational model of landing employs a set of equations to calculate the target inclinations and/or target azimuths for a sequence of control loops (e.g., HIA control loops) carried out during the AutoLand control mode. If and when used, the automatic switching between different landing computational models can be based on evaluation of elapsed measured depth and possibly other parameters. In one embodiment, the automatic switching between different landing computational models can be based on comparing elapsed measured depth to a predefined threshold value in feet, such as 30, 50, 90 or 120 feet. This threshold value can be downlinked or programmed into the drilling tool. The elapsed measured depth represents the measured depth of the drilling during the AutoLand control mode. The elapsed measured depth can be calculated downhole using the downhole ROP and possibly uplinked to the surface. The elapsed measured depth can be reset when activating or initiating the AutoLand control mode.

In embodiments, the AutoLand control mode can be configured to perform a "hybrid" computation model of landing during the AutoLand control mode. In the "hybrid" computational model of landing, a counter ("currDC") can be used to count drilling cycles performed during the AutoLand control mode. For the first drilling cycle (where currDC=1), the steering ratio (SR) parameter for the first drilling cycle can be calculated from an initial target build rate (BRTRGT_AL_INIT) parameter and a maximum dog leg severity ($DLS_{max}$) parameter of the drilling tool as follows:

$$SR\,(currDC = 1) = BRTRGT_{AL_{INIT}}/DLS_{max}. \quad \text{EQN. (3)}$$

Furthermore, the toolface demand (TF demand) for the first drilling cycle (where currDC=1) can be set to zero. The SR parameter and the toolface demand can be used to control the RSS tool during the first drilling cycle (where currDC=1) in the AutoLand control mode. The initial target build rate (BRTRGT_AL_INIT) can be based on build rate used in the other downhole control modes or manual modes. The maximum dog leg severity ($DLS_{max}$) can be a theoretical value dictated by tool size/tool type or can be obtained from offset data or can be adapted in the real-time.

For the subsequent drilling cycles (where currDC>1), the target inclination IncTarget for each subsequent cycle can be calculated as:

$$IncTarget(currDC) = IncTarget(currDC-1) + \frac{brTarget(currDC)}{100}\cdot \text{del_eMD} \quad \text{EQN. (4)}$$

$$AziTarget(currDC) = AziTarget(currDC = 1) = ContAziRSS(currDC = 1)$$

where brTarget(currDC) represents target build rate for the drilling cycle and can be derived from an initial target build rate (BRTRGT_AL_INIT) parameter, and del_eMD represents the elapsed measured distance for the drilling cycle and can be derived from the ROP during the drilling cycle.

Note that in the control scheme of Eqn. (4) the target azimuth is constant over the drilling cycles of the AutoLand control mode. This is for a case of 2-D landing with no turn. In other embodiments, the target azimuth can vary over the drilling cycles of the AutoLand control mode based on calculations similar to those used for the target inclination IncTarget for the drilling cycle in Eqn. (4). This is a case of 3-D landing and control over dog leg severity is needed instead of the build rate and the target GTF direction changes during the drilling cycles of the AutoLand control mode.

In embodiments, the AutoLand control mode can be configured to perform an "exponential" computational model of landing during the AutoLand control mode. In the "exponential" computational model of landing, a counter ("currDC") can be used to count drilling cycles performed during the AutoLand control mode. For each drilling cycle (currDC), the target inclination IncTarget for the drilling cycle can be calculated as:

$$ExpTermOnly\,(currDC) = \left(\frac{1}{L1}\right)\cdot((deltaInc - IncInit)\cdot(u(CurrDC) + u(CurrDC-1)) - L2\cdot ExpTermOnly(currDC-1) \quad \text{EQN. (5)}$$

$$IncTarget(currDC) = f(IncTarget(currDC-1), ExpTermOnly(CurrentDC))$$

where L1 and L2 are based on parameter L as follows:

$$L = 2\cdot\tau/\text{del_eMD},$$

$$\tau = \frac{AL\ MD\ \text{distance}}{4},$$

$$L1 = L + 1;$$

$$L2 = 1 - L,$$

the parameter AL MD distance is a given MD distance to landing, and where u, deltaInc, and Inclnit are parameters of the model.

The intent of the "exponential" computational model is to change the build rate of the drilling tool in a controlled manner to the landing inclination with DLS=0 (i.e. a build rate zero for a 2-D landing). In this "exponential" computational model, the target inclination IncTarget for the drilling cycles defines the path for the landing. Note that in the control scheme of Eqn. (5) the target azimuth is constant over the drilling cycles of the AutoLand control mode. This is for a case of 2-D landing with no turn. In other embodiments, the target azimuth can vary over the drilling cycles of the AutoLand control mode based on calculations similar to those used for the target inclination IncTarget for the drilling cycle in Eqn. (5). This is a case of 3-D landing and control over dog leg severity is needed instead of the build rate and the target GTF direction changes during the drilling cycles of the AutoLand control mode.

In embodiments, the parameter del_eMD represents the elapsed measured distance for a drilling cycle and can be derived from the ROP during the drilling cycle as follows:

$$\text{del_eMD} = \left(\frac{ROP\,(currDC)}{3600}\right)\cdot \text{update rate} \quad \text{EQN. (6)}$$

where update rate represents the rate at which the targets are updated in seconds (drill cycle update rate).

The elapsed measured distance (eMD) of drilling in the Autoland control mode (in ft) can be calculated from the sum or accumulation of the del_eMD parameter of Eqn. (6) over the drilling cycles leading up to current cycle. The parameter eMD representing the elapsed measured distance for all of the cycles of the Autoland control mode (in ft) can be calculated from the sum or accumulation of the del_eMD parameter of Eqn. (6) over all of the drilling cycles of the Autoland control mode.

In embodiments, the AutoLand control mode can be configured to automatically select or switch between the "hybrid" computational model of landing and the "exponential" computational model of landing based on comparing the elapsed measured depth (eMD) for the current drilling cycle (or previous drilling cycle) to a predefined threshold value in feet, such as 30, 50, 90 or 120 feet. Examples of AutoLand control modes that automatically select or switch between the "hybrid" computational model of landing and the "exponential" computational model are shown in TABLE 2 below.

TABLE 2

| Delta Inc (deg.) | MD distance (ft) for AutoLand | Build rate (deg./100 ft) before the AutoLand is engaged | Initial build rate target (BRTRGT__AL_INIT deg./100 ft) | eMD for switching between "hybrid" and "exponential" computational model of landing |
|---|---|---|---|---|
| 3 | 100 | >6.5 | 5 | 30 ft hybrid/30-100 ft exponential |
| 3 | 100 | <=6.5 | 4 | 50 ft hybrid/50 to 100 ft exponential) |
| 6 | 200 | >6.5 | 5 | 90 ft hybrid/90-200 ft exponential |
| 6 | 200 | <=6.5 | 4 | 120 ft hybrid/120-200 ft exponential |
| 6 | 100 | all | DLSmax | No hybrid (exponential only). |
| 3 | 200 | all | 2 | 100 ft hybrid/100-200 ft exponential |

In embodiments, the AutoLand control mode can be configured to automatically employ the "exponential" computational model of landing. Examples of AutoLand control modes that automatically employ the "exponential" computational model of landing are shown in TABLE 3 below.

TABLE 3

| Delta Inc (deg.) | MD distance (ft) for AutoLand | Build rate (deg./100 ft) before the AutoLand is engaged | Initial build rate target (BRTRGT__AL_INIT; deg./100 ft) applied in AL | eMD for "exponential" computational model of landing |
|---|---|---|---|---|
| 3 | 100 | all | DLSmax | 100 ft (exponential) |
| 3 | 200 | all | DLSmax | 200 ft (exponential) |
| 6 | 100 | all | DLSmax | 100 ft (exponential) |
| 6 | 200 | all | DLSmax | 200 ft (exponential) |

Embodiments described are configured for downhole implementation via one or more controllers deployed downhole (e.g., in a steering/directional drilling tool). A suitable controller may include, for example, a programmable processor, such as a microprocessor or a microcontroller and processor-readable or computer-readable program code embodying logic. A suitable processor may be utilized, for example, to execute the method embodiments described above. A suitable controller may also optionally include other controllable components, such as sensors (e.g., a depth sensor), data storage devices, power supplies, timers, and the like. The controller may also be disposed to be in electronic communication with the attitude sensors (e.g., to receive the continuous inclination and azimuth measurements). A suitable controller may also optionally communicate with other instruments in the drill string, such as, for example, telemetry systems that communicate with the surface. A suitable controller may further optionally include volatile or nonvolatile memory or a data storage device.

The disclosed embodiments may further include a downhole steering tool having a downhole steering tool body, a steering mechanism for controlling a direction of drilling a subterranean wellbore and sensors for measuring attitude (i.e., inclination and azimuth) of the wellbore as it is drilled. The steering tool may further include a downhole controller including one or more modules that embody a cascade closed-loop system (e.g., FIG. 9) that processes parameter data and attitude measurements received from the sensors to control the direction of drilling as described herein.

Figure 10:
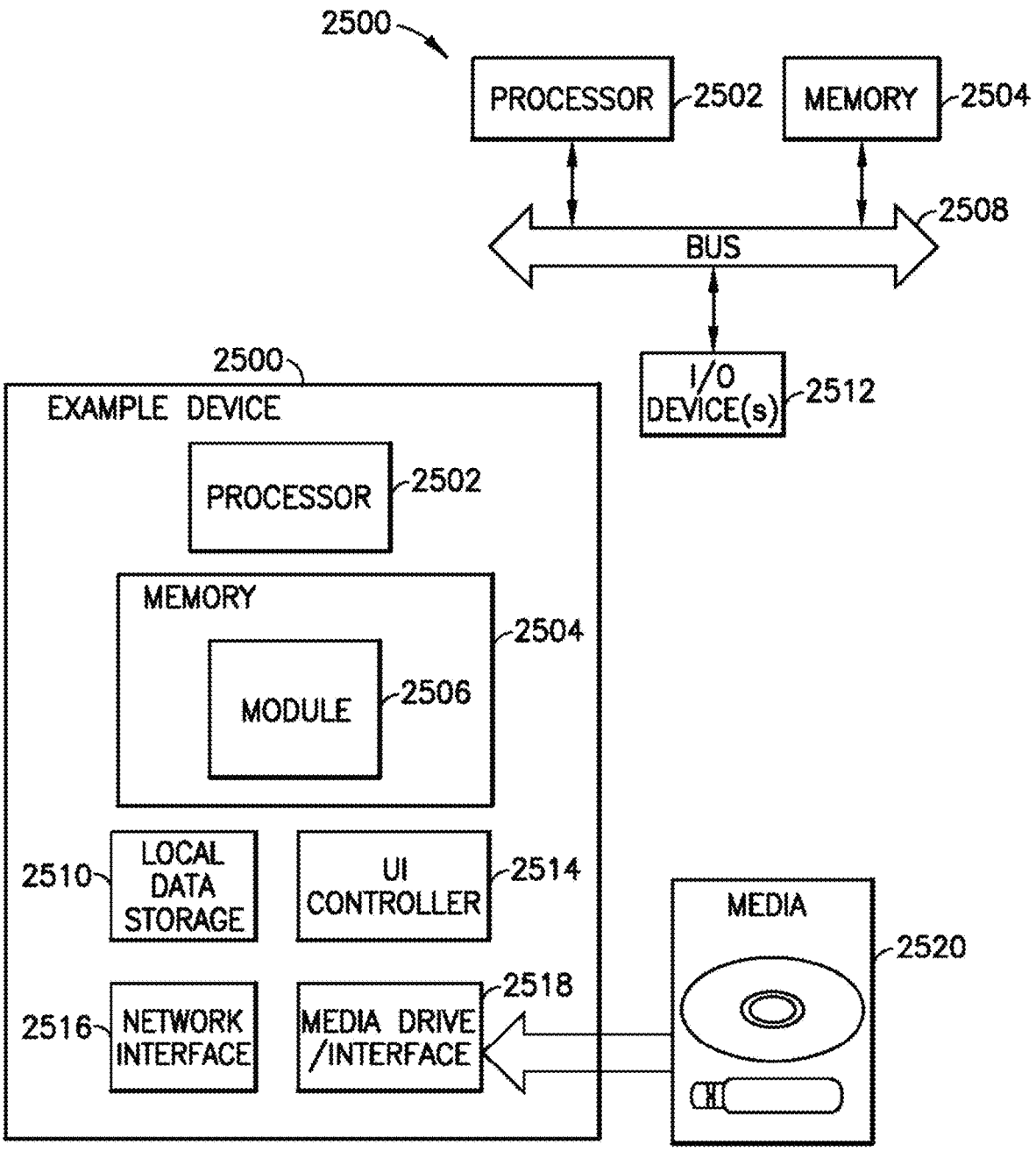
FIG. 10 is a schematic diagram of a computer processing system.

FIG. 10 illustrates an example device 2500, with a processor 2502 and memory 2504 that can be configured to implement various embodiments of the processes and systems as discussed in the present application. For example, various steps or operations of the processes or systems as described herein can be embodied by computer program instructions (software) that execute on the device 2500. Memory 2504 can also host one or more databases and can include one or more forms of volatile data storage media such as random-access memory (RAM), and/or one or more forms of nonvolatile storage media (such as read-only memory (ROM), flash memory, and so forth).

Device 2500 is one example of a computing device or programmable device and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more of computers, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth). One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network. A media drive/interface 2518 can accept removable tangible media 2520, such as flash drives, optical disks, removable hard drives, software products, etc. In one possible implementation, logic, computing instructions, and/or software programs comprising elements of module 2506 may reside on removable media 2520 readable by media drive/interface 2518.

In one possible embodiment, input/output device(s) 2512 can allow a user (such as a human annotator) to enter commands and information to device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various processes and systems of present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable, and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer.

Some of the methods and processes described above can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, general-purpose computer, special-purpose machine, virtual machine, software container, or appliance) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Some of the methods and processes described above can be implemented as computer program logic for use with the computer processor. The computer program logic may be embodied in various forms, including a source code form or a computer executable form. Source code may include a series of computer program instructions in a variety of programming languages (e.g., object code, assembly language, or high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server over a communication network (e.g., the Internet).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

The invention claimed is:

1. A method for automated closed-loop control of drilling trajectory during directional drilling, the method comprising:

defining target inclinations and/or target azimuths for a sequence of automated control loops performed over distances of measured depth during directional drilling, wherein the target inclinations and/or target azimuths include:

a first target inclination and/or a first target azimuth for a first automated control loop included in the sequence of automated control loops, and a second target inclination and/or a second target azimuth for a second automated control loop included in the sequence of automated control loops;

drilling, using a toolface, in one or more first directions according to the first target inclination and/or the first target azimuth during the first automated control loop; and drilling, using the toolface, in one or more second directions according to the second target inclination and/or the second target azimuth during the second automated control loop, wherein the sequence of automated control loops transition from drilling a curve or bend in a wellbore to drilling a horizontal or lateral section or tangent section of the wellbore, and wherein the sequence of automated control loops employs a plurality of nudge operations that define the target inclinations and/or target azimuths for the sequence of automated control loops such that each target inclination and/or target azimuth is less than a previous target inclination and/or target azimuth according to an exponential function.

2. The method of claim 1, wherein:

the distances of measured depth are less than 100 feet.

3. The method of claim 1, wherein:

the sequence of automated control loops is configured to incrementally change dog leg severity of the wellbore in a pre-defined manner with a dog leg severity being at or near zero.

4. The method of claim 1, further comprising:

activating or initiating the sequence of automated control loops by instructions or commands from a drilling operator, or automatically by instructions or commands from a processor or other programmed controller during directional drilling.

5. The method of claim 4, wherein:

the activation or initiation of the sequence of automated control loops is performed automatically based on at least one parameter that specifies an offset relative to a target landing.

6. The method of claim 5, wherein:

the at least one parameter specifies a predefined offset from a target landing inclination; and the activation or initiation of the sequence of automated control loops occurs automatically in an event that an inclination of drilling represented by target inclination or measured inclination reaches the predefined offset from the target landing inclination.

7. The method of claim 1, further comprising:

terminating the sequence of automated control loops by instructions or commands from a drilling operator, or automatically by instructions or commands from a processor or other programmed controller during directional drilling.

8. The method of claim 7, wherein:

the termination of the sequence of automated control loops is performed automatically based on at least one parameter that specifies an offset relative to a target landing.

9. The method of claim 8, wherein:

the at least one parameter specifies a predefined offset of measured depth from the target landing, and the termination of the sequence of automated control loops occurs automatically in an event that an elapsed measured depth of drilling during the sequence of automated control loops matches or corresponds to the predefined offset of measured depth from the target landing.

10. The method of claim 1, wherein:

a rate of penetration of drilling during the sequence of automated control loops is kept constant or estimated downhole and used as input to a processor or other programmed controller.

11. The method of claim 1, wherein:

the sequence of automated control loops is configured by a pre-determined setting that is set before drilling the wellbore.

12. The method of claim 1, wherein:

the plurality of nudge operations use rate of penetration (ROP) of the directional drilling as an input.

13. The method of claim 12, wherein:

the rate of penetration (ROP) of the directional drilling is controlled via a surface controller or estimated downhole by a processor or other programmed controller.

14. The method of claim 1, wherein:

the plurality of nudge operations calculate the target inclinations and/or target azimuths for the sequence of automated control loops by changing a dog leg severity of the directional drilling over a specified measured depth or distance.

15. The method of claim 1, wherein:

the plurality of nudge operations calculate the target inclinations and/or the target azimuths for the sequence of automated control loops based on variable dog leg severity demand.

16. The method of claim 15, wherein the variable dog leg severity demand is represented by variable percentage values of a dog leg severity of the curve of the wellbore at a start of the method.

17. The method of claim 1, wherein:

the plurality of nudge operations calculate the target inclinations and/or the target azimuths for the sequence of automated control loops based on variable toolface demand.

18. The method of claim 17, wherein:

the variable toolface demand is configured to automatically change target inclination and/or the target azimuth over distances of measured depth during directional drilling for a predefined total change in inclination over measured depth of drilling.

19. The method of claim 17, wherein:

the variable toolface demand is based on at least one predefined function or computational model of landing having elapsed measure depth as an independent variable.

20. The method of claim 17, wherein:

the variable toolface demand is based on a plurality of different computational models of landing that are automatically selected by evaluating elapsed measured depth of drilling.

21. The method of claim 1, wherein:

the sequence of automated control loops comprise HIA control loops that continuously monitor and control a drilling toolface to drill in a direction corresponding to the target inclinations and/or target azimuths.

* * * * *